US005752317A

United States Patent [19]

Keating et al.

[11] Patent Number: 5,752,317

[45] Date of Patent: May 19, 1998

[54] METHOD OF RESTRICTING TRANSVERSE DISPLACEMENT OF A NUCLEAR HEAT EXCHANGER TUBE SUPPORT PLATE

[75] Inventors: Robert F. Keating, Penn Township; Thomas A. Pitterle, Greensburg; Warren R. Junker, Monroeville; William K. Cullen, Penn Hills, all of Pa.

[73] Assignee: Westinghouse Electric Corporation, Pittsburgh, Pa.

[21] Appl. No.: 572,975

[22] Filed: Dec. 15, 1995

[51] Int. Cl.[6] ..... B23P 15/26

[52] U.S. Cl. ..... 29/890.044; 29/723; 29/727

[58] Field of Search ..... 29/890.044, 723, 29/727, 523; 165/162

[56] References Cited

U.S. PATENT DOCUMENTS

| | | | |
|---|---|---|---|
| 4,262,402 | 4/1981 | Cooper, Jr. et al. | 29/157.4 |
| 4,390,042 | 6/1983 | Kucherer et al. | 138/89 |
| 4,590,991 | 5/1986 | Cooper, Jr. et al. | 165/69 |
| 4,699,759 | 10/1987 | Feild, Jr. | 376/446 |
| 5,329,565 | 7/1994 | Moore | 376/402 |

*Primary Examiner*—Irene Cuda

[57] ABSTRACT

Method of restricting transverse displacement of a nuclear heat exchanger tube support plate during a transient event, the support plate having a plurality of holes therethrough for passage of respective ones of a plurality of heat transfer tubes. The method includes radially expanding the tube adjacent the first side of the support plate to define a first expanded region thereat, the tube being expanded to a diameter greater than the diameter of the hole formed through the support plate. The method further includes radially expanding the tube adjacent the second side of the support plate to define a second expanded region thereat, the tube being expanded to a diameter greater than the diameter of the hole formed through the support plate. The first expanded region and the second expanded region coact to restrict transverse displacement of the support plate because the support plate is firmly captured between the first expanded region and the second expanded region.

13 Claims, 7 Drawing Sheets

METHOD OF RESTRICTING TRANSVERSE DISPLACEMENT OF A NUCLEAR HEAT EXCHANGER TUBE SUPPORT PLATE

BACKGROUND OF THE INVENTION

This invention generally relates to methods of stabilizing movement of plate members and more particularly relates to a method of restricting transverse displacement or deflection of a nuclear heat exchanger tube support plate during a transient event, which tube support plate may be of the type found in nuclear steam generators.

In a pressurized water nuclear reactor, the heat generated by a nuclear reaction in a reactor core is absorbed by a primary coolant that circulates through the reactor core and that is then utilized to generate steam in a steam generator. The steam generator itself is an upright cylindrical pressure vessel with hemispherical end sections. A transverse tubesheet, located at the lower end of the cylindrical section, divides the steam generator into a primary side below the tubesheet and a secondary side above the tubesheet. Below the tubesheet, a vertical wall (i.e., divider plate) bisects the primary side into an inlet section and an outlet section. The tubesheet has an array of thousands of holes into which are inserted the ends of U-shaped tubes that are designed to be leak-tight. One end of each U-shaped tube is inserted and anchored into a hole in the tubesheet which communicates with the inlet section of the primary side and the other end is inserted and anchored into another hole in the tubesheet which communicates with the outlet section of the primary side. The steam generator also includes a plurality of spaced-apart transverse tube support plates having holes for passage of the tubes therethrough. The purpose of the support plates is to laterally support the tubes.

The primary coolant is introduced under pressure into the inlet section of the primary side, circulates through the U-shaped tubes and exits through the outlet section of the primary side. Water introduced into the secondary side of the steam generator circulates around the U-shaped tubes and is transformed into steam by heat given up by the primary coolant. The steam is transported to a turbine-generator by means of a main steam line or pipe interconnecting the steam generator and the turbine-generator in order to produce electricity in a manner well known in the art.

Occasionally, the tubes may degrade such that the degradation may exceed operability or plugging limits established by the U.S. Nuclear Regulatory Commission. Such degradation may progress to the point where the tube is no longer leak-tight. Such degradation may occur, for example, in the region of the tube that passes through the tube support plate. A leaking tube is undesirable because the primary coolant is radioactive and any leakage of reactor coolant into the secondary side of the steam generator will radioactively contaminate the steam generated in the secondary side.

However, during postulated accident conditions, such as a postulated break in the main steam line, pressure differentials across the tube support plates may act to displace the support plates in such a manner as to uncover any degradation present in the tube where the tube passes through the support plate. More specifically, once a steam line break event begins, it triggers a rapid depressurization which leads to water flashing in the steam generator resulting in blowdown of steam and water out of the steam generator. The rapid water flashing occasioned by the steam line break generates water motion, the velocity of the water increasing as the amount of water flashing increases. Such an increased water velocity leads to a relatively large pressure drop across each tube support plate and thus increases the hydraulic loads across the tube support plate. This increased hydraulic loading may be sufficient to cause the tube support plate to be transversely displaced or deflected.

If the crack in the wall of the heat transfer tube is axial in orientation, the presence of the tube support plate precludes the ability of the crack to open-up, and therefore precludes tube burst or rupture, even for axially oriented degradation of a length equal to the tube support plate thickness. The resistance to crack opening provided by the proximity of the tube support plate precludes tube burst or rupture in tubes with axially oriented degradation in the area adjacent to the tube support plate for internal tube pressures far above the internal tube pressure experienced during the steam line break event. If the crack in the wall of the heat transfer tube is circumferential in orientation, the pressure of the primary coolant flowing through the tube may be sufficient to open-up the crack. Such a crack would be otherwise constrained by the surrounding nondeflected support plate because the intimate engagement of the support plate and tube wall will tend to limit the extent of the crack opening and thus the flow rate which can leak from the crack opening.

In addition, any through-wall cracks occasioned by the previously mentioned degradation may become uncovered by transverse displacement or deflection of the support plate. This is undesirable because coolant leakage from such an exposed crack will be greater than leakage from the same crack when covered by the support plate. This is so because the support plate surrounding the cracked tube acts as an obstacle to fluid flow through the crack.

Moreover, the circumferential crack may be severe enough to cause the tube to sever. Severing of the tube in this manner will produce opposing severed tube ends and displacement of the support plate may be enough to expose the severed tube ends. Lateral movement of such severed tube ends would be otherwise constrained by the surrounding nondeflected support plate. However, if the tube is severed while the support plate is deflected or displaced, then the resulting severed tube ends become unconstrained by the tube support plate and may laterally move due to the previously mentioned hydraulic forces produced during the transient event. Such lateral movement of the severed tube ends may be sufficient to damage adjacent nonleaking heat transfer tubes during the transient event.

Hence, a problem in the art is to restrict movement of the tube support plate during accident or transient events in order to reduce primary coolant leakage and to reduce the possibility of damage to adjacent nonleaking tubes.

Therefore, what is needed is a method of restricting transverse displacement of a nuclear heat exchanger tube support plate during a transient event, which tube support plate may be of the type found in nuclear steam generators.

SUMMARY OF THE INVENTION

Disclosed herein is a method of restricting transverse displacement of a nuclear heat exchanger tube support plate during a transient event, the support plate having a plurality of holes therethrough for passage of respective ones of a plurality of heat transfer tubes. The method includes radially expanding the tube adjacent a first side of the support plate to define a first expanded region thereat, the tube being expanded to a diameter greater than the diameter of the hole formed through the support plate. The method further includes radially expanding the tube adjacent a second side of the support plate to define a second expanded region thereat, the tube being expanded to a diameter greater than the diameter of the hole formed through the support plate. The first expanded region and the second expanded region coact to restrict transverse displacement of the support plate because the support plate is firmly captured between the first expanded region and the second expanded region.

An object of the present invention is to provide a method to restrict transverse displacement of a heat transfer tube support plate during a steam generator transient event (e.g., main steam line break).

A feature of the present invention is the provision of expanded regions or expansion joints in the heat transfer tube on either side of the support plate in order to firmly capture the support plate therebetween so as to restrict transverse displacement or deflection of the support plate.

An advantage of the present invention is that a crack in the heat transfer tube at the elevation of the support plate will not be uncovered during the steam generator transient event.

Another advantage of the present invention is that the stiffness of tube is increased so that severed tube ends caused by a through-wall crack in the tube do not laterally move during the transient event to damage an adjacent tube.

A further advantage of the present invention is that tube expansion in combination with restriction of support plate movement reduces axial tube burst probability to a negligible level in the typical nuclear generator; thus, tube repair limits are not required to satisfy tube burst margins because the probability of tube burst is negligible.

These and other objects, features, and advantages of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

While the specification concludes with claims particularly pointing out and distinctly claiming the subject matter of the invention, it is believed the invention will be better understood from the following description taken in conjunction with the accompanying drawings wherein:

DESCRIPTION OF THE PREFERRED EMBODIMENTS

Figure 1:
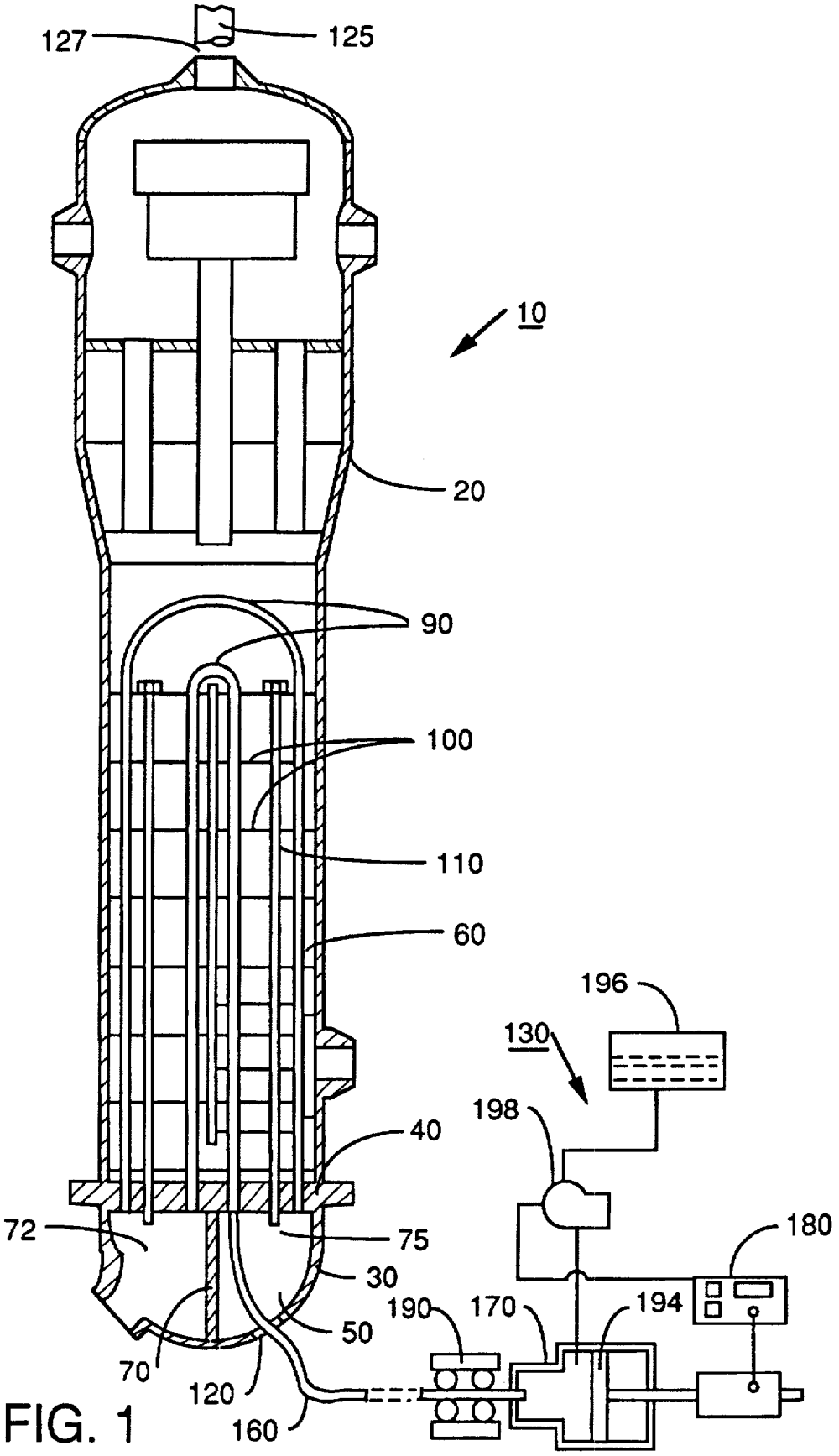
FIG. 1 is a view in partial vertical section of a typical nuclear steam generator with parts removed for clarity, the steam generator having a plurality of U-shaped heat transfer tubes passing through a plurality of tube support plates, each tube having ends thereof received through holes in a tubesheet.

Referring to FIG. 1, there is shown a typical nuclear exchanger or steam generator, generally referred to as 10, for generating steam. Steam generator 10 comprises a cylindrical body portion 20 enclosed at its lower end by a hemispherical shell 30. A transverse plate or tubesheet 40 divides steam generator 10 into a primary side 50 below tubesheet 40 and a secondary side 60 above tubesheet 40. The primary side 50 is divided by a divider plate 70 into an inlet section 72 ("hot leg" side) and an outlet section 75 ("cold leg" side).

Still referring to FIG. 1, tubesheet 40 has a plurality of holes 80. A plurality of U-shaped heat transfer tubes 90 (only two of which are shown) have ends received in respective ones of the holes 80 so that one end of each tube 90 communicates with inlet section 72 and the other end of each tube 90 communicates with outlet section 75. Each tube 90 is laterally supported on secondary side 60 by a plurality of spaced-apart parallel transverse plate members, such as support plates 100, that are braced by tierods 110. Each support plate 100 has a first side 105 and a second side 107 opposite first side 105. In addition, each support plate 100 has a plurality of holes 108 formed therethrough for passage of each tube 90, each hole 108 having a predetermined diameter. A plurality of manways 120 (only one of which is shown) provide access to inlet section 72 and outlet section 75 to allow servicing of steam generator 10. Steam generated by steam generator 10 is transported to a turbine-generator (not shown) by means of a pipe or main steam line 125. However, main steam line 125 may have an inadvertent break 127 therein causing a depressurization transient in steam generator 10.

Figure 2:
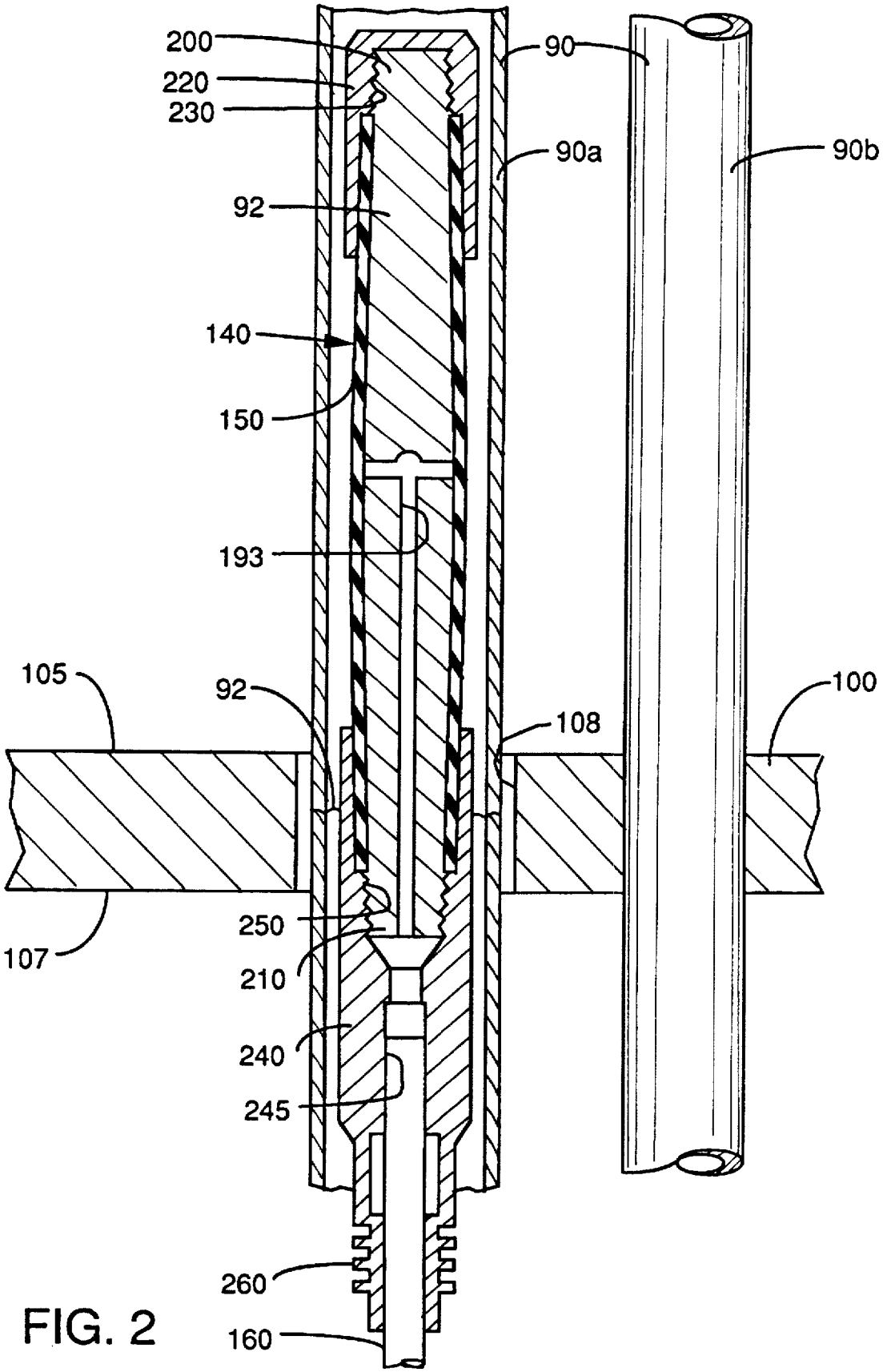
FIG. 2 is a view in vertical section of an expansion mandrel disposed in one of the tubes for expanding predetermined portions thereof, the tube having a circumferentially extending crack therein at the elevation of the support plate.

Referring to FIGS. 1 and 2, there is shown expansion means, which may be a hydraulic expansion unit generally referred to as 130, for controllably expanding tubular members, such as a predetermined tube **90*a* which may have a circumferentially extending crack 92 in the wall thereof. Disposed adjacent tube 90*a* is another one of the tubes 90, such as tube 90*b*. Expansion unit 130 comprises a mandrel, generally referred to as 140, insertable into tube 90*a* and having an expandable bladder 150 thereon for reasons disclosed presently. Connected to mandrel 140 and in communication with bladder 150 is a flexible conduit 160 for reasons disclosed hereinbelow. Conduit 160 is connected to a pressurizer 170 for supplying a pressurized fluid (e.g., gas and/or liquid) through conduit 160 and to mandrel 140 to radially expand bladder 150, in the manner disclosed in more detail hereinbelow. Control means, such as a controller or computer 180, is connected to pressurizer 170 for controllably operating pressurizer 170, so that pressurizer 170 controllably supplies the pressurized fluid to mandrel 140 in order to controllably pressurize bladder 150 to a predetermined pressure. In addition, a conduit driver 190 engages conduit 160 for driving or translating conduit 160 and the mandrel 140 connected thereto along the longitudinal axis of tube 90*a***.

Referring to FIG. 1, pressurizer 170 may comprise a piston arrangement therein for pressurizing the fluid supplied by pressurizer 170 to mandrel 140. Pressurizer 170 may also include a fluid reservoir 196 in fluid communication with piston arrangement 194 for providing fluid to piston arrangement 196, which fluid is then pressurized by piston arrangement 194. Moreover, controller 180 is electrically connected to pressurizer 170 and may be electrically connected to a pumping mechanism 198 for controllably operating piston arrangement 194 and pumping mechanism 198. Piston arrangement 194 and pumping mechanism 198 controllably supply the fluid to mandrel 140 and withdraws the fluid from mandrel 140 in order to controllably pressurize and depressurize bladder 150, respectively.

As best seen in FIG. 2, mandrel 140 comprises an elongate central body 192 having an externally threaded distal end portion 200 and an externally threaded proximal end portion 210. A channel 193, which is in communication with bladder 150, extends longitudinally in central body 192 for conducting fluid to and away from bladder 150 in order to pressurize and depressurize bladder 150, respectively. Threadably connected to distal end portion 200 is a threaded nose member 220. Nose member 220 has an internally threaded step bore 230 therein for threadably engaging the external threads of distal end portion 200. In addition, threadably connected to proximal end portion 210 is a threaded end fitting 240. End fitting 240 has an internally threaded step bore 250 therein for threadably engaging the external threads of proximal end portion 210 of central body 192. A distal end portion of bladder 150 is sealingly captured, such as by a press fit, between nose member 220 and central body 192. Similarly, a proximal end portion of bladder 150 is sealingly captured, such as by a press fit, between proximal end portion 210 of central body 192 and end fitting 240. Moreover, attached to end fitting 240 may be a non-destructive examination device, such as an eddy current probe 260, for precisely locating support plate 100 and to determine the presence of crack 92. In this regard, it is important to precisely locate support plate 100 for reasons disclosed hereinbelow. End fitting 240 has a bore 245 therein for receiving an end portion of conduit 160, the bore 245 being in communication with channel 193 formed in central body 192 and the end portion of conduit 160. In this manner, fluid can be conducted from conduit 160 and into channel 193 to pressurize bladder 150 and conducted from channel 193 and into conduit 160 to depressurize bladder 150. It will be appreciated that the terminology "proximal end portion" is defined herein to mean that end portion disposed nearer divider plate 70 and the terminology "distal end portion" is defined herein to mean that end portion farther away from divider plate 70. A suitable hydraulic expansion unit may be of the type disclosed in U.S. patent application Ser. No. 08/192,536 titled "Apparatus And Method For Expanding Tubular Members" filed Feb. 7, 1994 in the name of David A. Snyder, the disclosure of which is hereby incorporated by reference.

Figure 3:
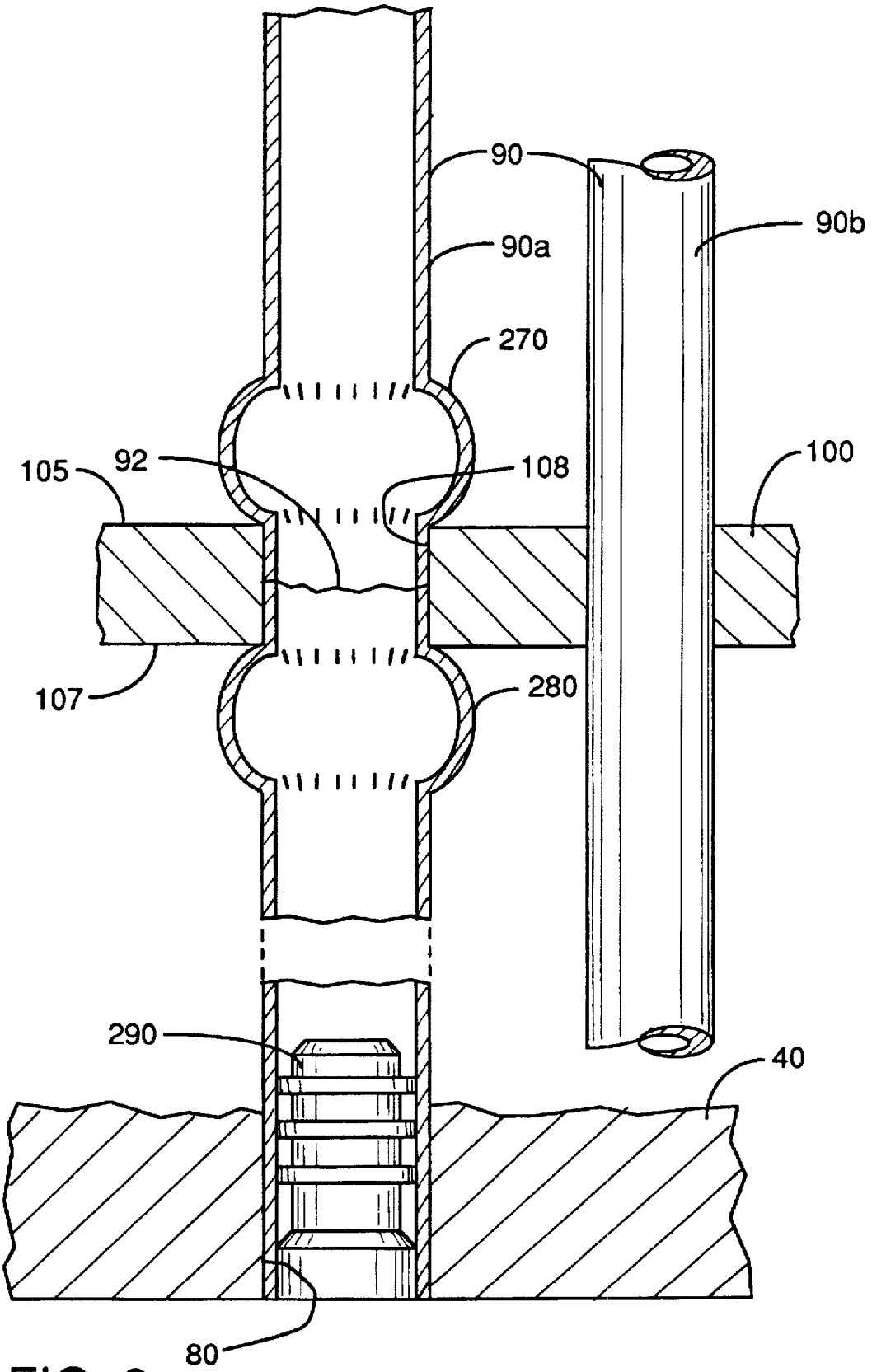
FIG. 3 is a view in vertical section of the tube expanded so as to restrict transverse displacement or deflection of the support plate.

Turning now to FIG. 3, hydraulic expansion unit 130 is used to expand tube 90*a* in the manner disclosed hereinbelow in order to restrict transverse displacement or deflection of support plate 100. In this regard, mandrel 140 is inserted through manway 120 and into tube 90*a*. Thereafter, conduit driver 190 is operated to translate mandrel 140 in tube 90*a* as eddy current device 260 is operated. Eddy current device 260 is capable of detecting the presence of each support plate 100 and the presence of any crack 92 present in the wall of tube 90 at the elevation of support plate 100. As described in more detail presently, expansion unit 130 is used to expand portions of tube 90*a* in order to restrict transverse displacement of support plate 100 so that support plate 100 does not uncover crack 92 during a rapid depressurization transient event, such as might occur during a break in main steam line 125. In this regard, operation of expansion unit 130 causes bladder 140 to pressurize and then radially expand in order to radially expand tube 90*a* at a first location adjacent first side 105 of support plate 100. At this first location, tube 90*a* is radially expanded to a diameter greater than the diameter of hole 108 formed through support plate 100 so as to define a first expanded region 270. Bladder 140 is then depressurized by operation of expansion unit 130. Mandrel 140 is translated to another location in tube 90*a* whereupon operation of expansion unit 130 causes bladder 140 to pressurize and then expand in order to radially expand tube 90*a* at a second location adjacent second side 107 of support plate 100. At this second location, tube 90*a* is radially expanded to a diameter greater than the diameter of hole 108 formed through support plate 100 so as to define a second expanded region 280. Bladder 140 is then depressurized by operation of expansion unit 130. The first expanded region 270 and the second expanded region 280 coact to restrict transverse displacement or deflection of support plate 100 because first expanded region 270 and second expanded region 280 create obstacles or impediments to movement (i.e., displacement or deflection) of support plate 100 in its transverse direction. In other words, first expanded region 270 and second expanded region 280 firmly capture support plate 100 therebetween in order to limit transverse displacement or deflection of support plate 100.

Still referring to FIG. 3, a suitable tube plug 290 may be sealingly installed into each end of tube 90*a* to prevent primary fluid from entering tube 90*a*. Such a tube plug may be of the type disclosed in U.S. Pat. No. 4,390,042 titled "Tube Plug" issued Mar. 5, 1985 in the name of Harvey J. Kucherer et al., the disclosure of which is hereby incorporated by reference. Plugging tube 90*a* removes tube 90*a* from service so that the primary fluid can not enter tube 90*a* to leak through crack 92 and so that the primary fluid can not further corrosively attack tube 90*a*. Moreover, expansion and plugging of tube 90*a* provides structure to "tie" the support plates 100 together.

However, the expanded tube 90*a* could degrade circumferentially at the edges of support plate 100 where the walls of tube 90*a* transition into expanded regions 270/280. Such degradation, although unlikely, could be severe enough to cause tube 90*a* to sever such that successive support plates 100 are no longer axially "tied" together.

Figure 4:
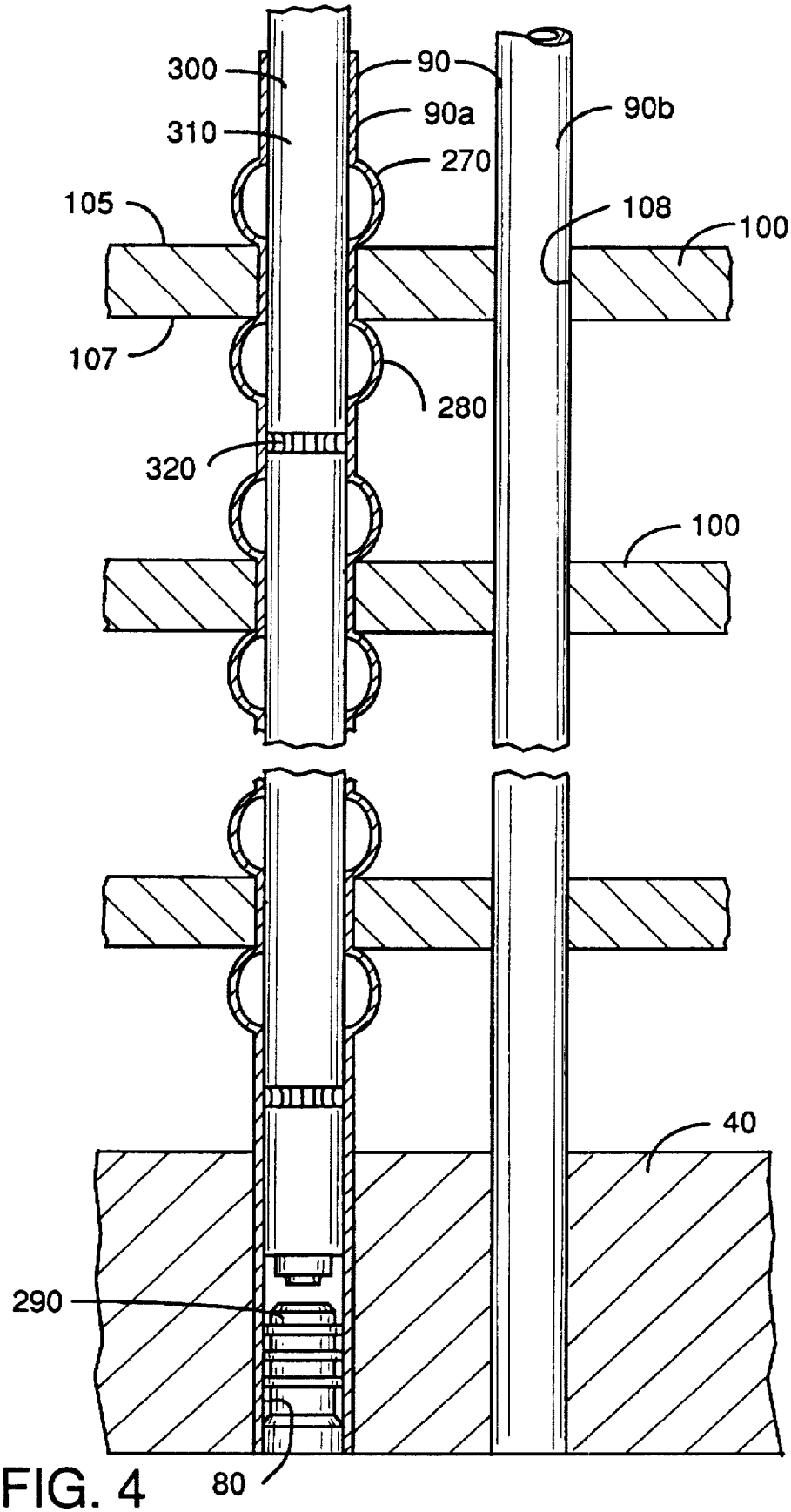
FIG. 4 is a view in partial vertical section of another embodiment of the invention, wherein a flexible stayrod is disposed in the expanded tube to prevent lateral movement of the tube.

Therefore, FIG. 4 shows an alternative embodiment of the invention, wherein a flexible stayrod 400 is disposed in tube 90*a* to simultaneously span at least the first expanded region 270 and second expanded region 280 for "tying" support plates 100 together axially and for restricting lateral movement of tube 90*a* in the event tube 90*a* severs. More specifically, stayrod 400 preferably includes a plurality of spaced-apart adjacent rigid members 410 interconnected by a flexible cable 420 so that stayrod 400 is sufficiently flexible to drape over the U-bend portion of tube 90*a* yet rigid enough to provide lateral support to tube 90*a* and to "tie" support plates 100 together axially. Stayrod 300, which drapes across the U-bend portion of tube 90*a* and hangs downwardly into the region of tubesheet 40, is preferably disposed in tube 90*a* after first expanded region 270 and second expanded region 280 are formed but before tube plug 290 is installed.

Figure 5:
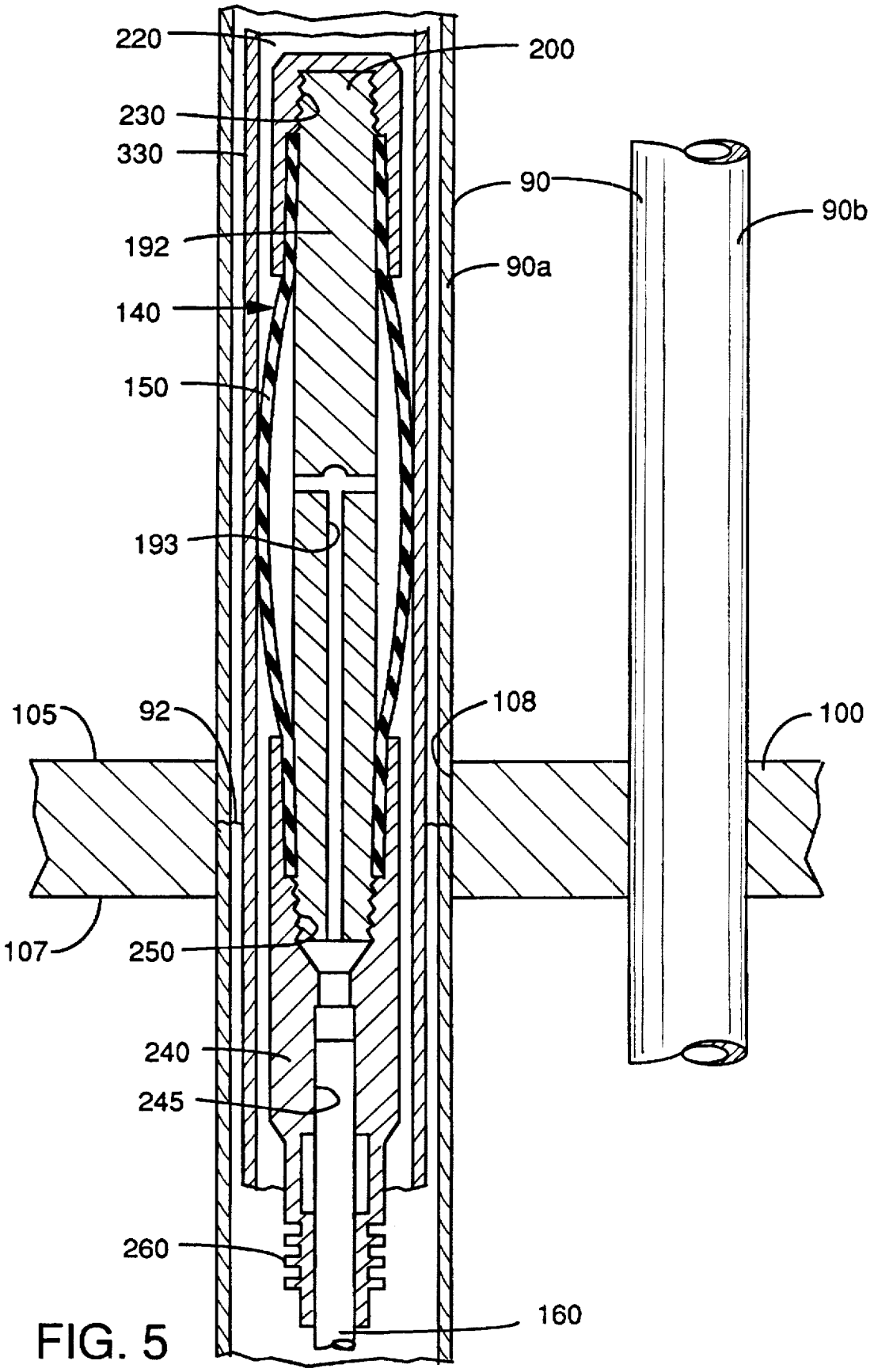
FIG. 5 is a view in vertical section of the mandrel disposed the tube, the mandrel having a sleeve theresurrounding.
Figure 6:
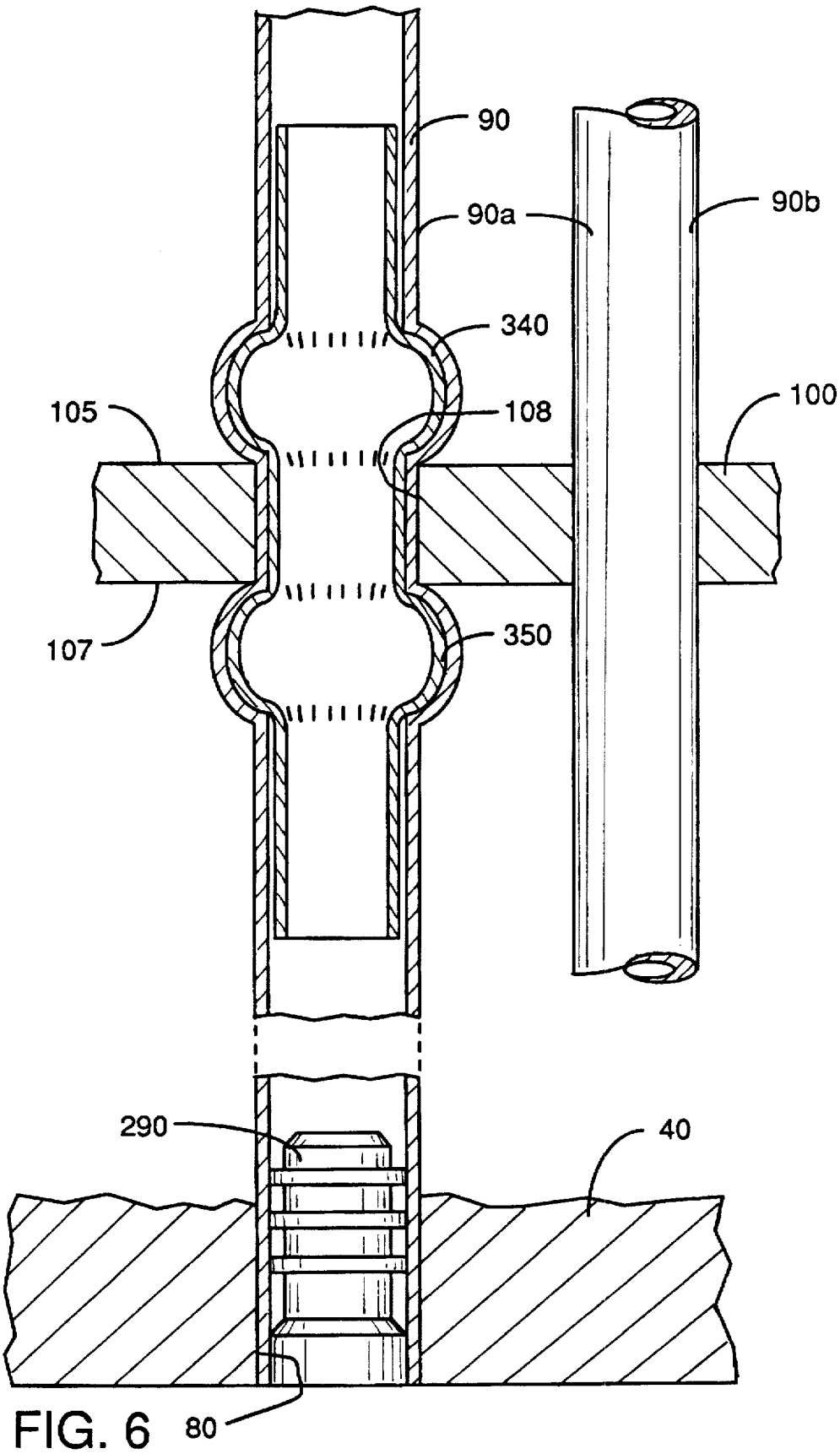
FIG. 6 is a view in vertical section of yet another embodiment of the invention, wherein the tube and sleeve combination are expanded so as to restrict transverse displacement of the support plate and to prevent lateral movement of the tube should the tube become severed at a postulated crack location in the tube adjacent to either the upper or lower surfaces of the tube support plate.

Referring now to FIGS. 5 and 6, there is shown yet another embodiment of the present invention. In this embodiment of the invention, a cylindrical sleeve 330 is connected to mandrel 140 by surrounding bladder 150 with sleeve 330 and then operating expansion unit 130 to partially pressurize bladder 150, but without expanding sleeve 330, so that sleeve 330 is secured to bladder 150 by force of friction. Mandrel 140, with sleeve 330 secured thereto, is inserted through manway 120 and translated to a first location in tube 90*a* by operation of conduit driver 190. Expansion unit 130 is thereafter operated in the manner disclosed hereinabove to pressurize bladder 150 in order to further expand bladder 150 such that sleeve 330 and the wall of tube 90*a* are simultaneously radially expanded adjacent first side 105 of support plate 100. Sleeve 330 and tube 90*a* are simultaneously expanded adjacent first side 105 of support plate 100 to a diameter greater than the diameter of hole 108 formed through support plate 100. Bladder 150 is then depressurized by operation of expansion unit 130. This first expansion defines a sleeve-to-tube first expansion joint 340 at this first location. Similarly, mandrel 140 is translated in tube 90*a* to a second location and expansion unit 130 is operated to pressurize bladder 150 in order to expand bladder 150 such that sleeve 330 and the wall of tube 90*a* are simultaneously radially expanded adjacent second side 107 of support plate 100. Sleeve 330 and tube 90*a* are simultaneously expanded adjacent second side 107 of support plate 100 to a diameter greater than the diameter of hole 108 formed through support plate 100. This second expansion defines a sleeve-to-tube second expansion joint 350 at this second location. In this manner, sleeve 330 is affixed to tube 90*a* so as to bridge or cover crack 92. Also, first expansion joint 340 and second expansion joint 350 coact to restrict transverse displacement of support plate 100. Moreover, plug 290 may be sealingly disposed in open end 80 of tube 90*a* to seal tube 90*a* so that the primary fluid will not enter tube 90*a* to further corrode tube 90*a* and sleeve 330.

Figure 7:
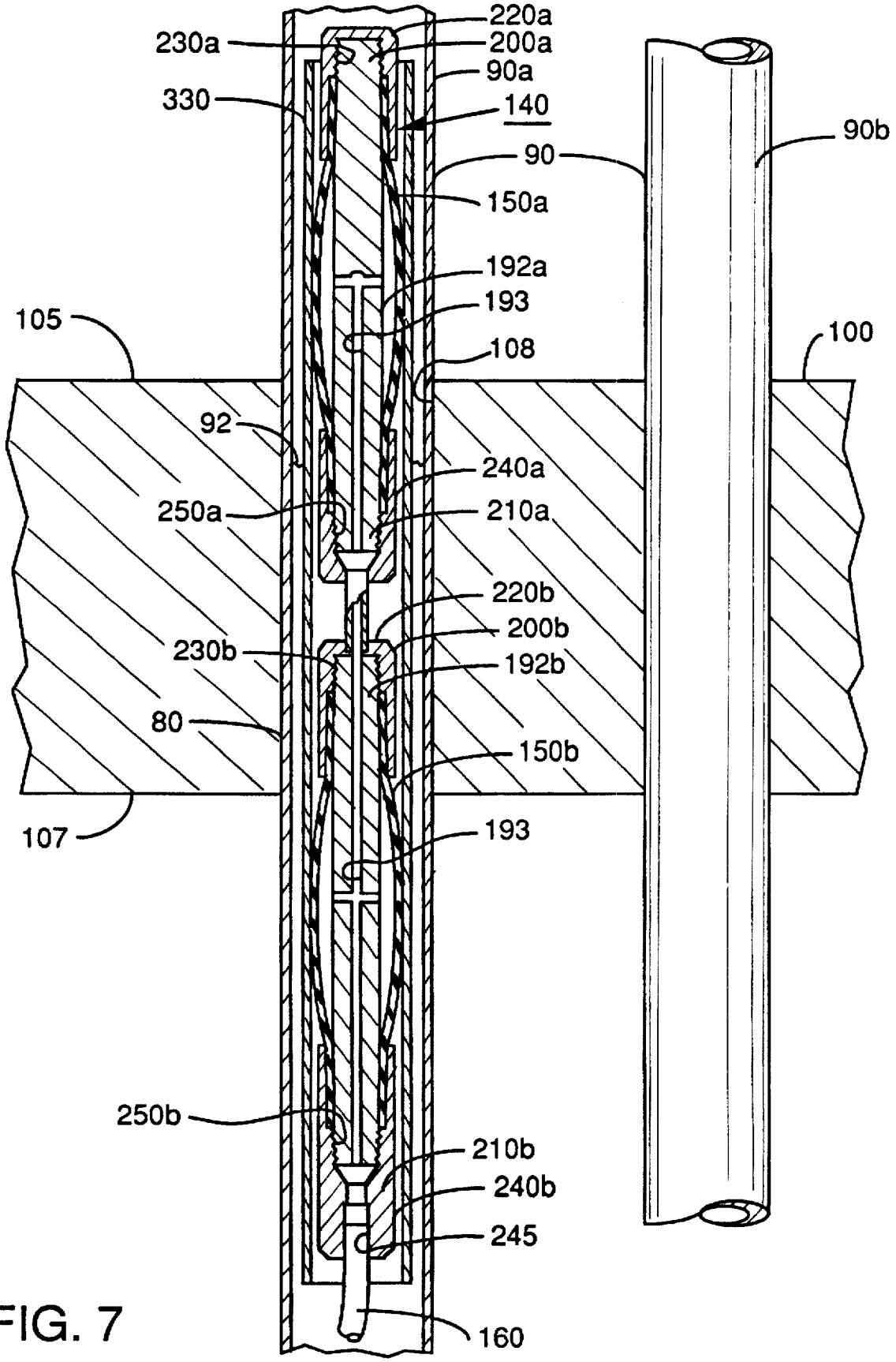
FIG. 7 is a view in vertical section of an alternative embodiment of the mandrel disposed in the tube, the mandrel having the sleeve theresurrounding.

Referring to FIG. 7, there is shown an alternative embodiment of mandrel 140 comprising a pair of elongate central bodies 192*a* and 192*b* each having an externally threaded distal end portion 200*a*/200*b* and an externally threaded proximal end portion 210*a*/210*b*. Channel 193, which is in communication with a pair of bladders 150*a*/150*b*, extends longitudinally in central bodies 192*a*/192*b* for conducting fluid to and away from bladders 150*a*/150*b* in order to pressurize and depressurize bladders 150*a*/150*b*, respectively. Threadably connected to respective ones of distal end portions 200*a*/200*b* is a threaded nose member 220*a* and 220*b*. Each nose member 220*a*/220*b* has an internally threaded step bore 230*a*/230*b* therein for threadably engaging the external threads of distal end portions 200*a*/200*b*. In addition, threadably connected to each of the proximal end portions 210*a*/210*b* is an internally threaded end fitting 240*a*/240*b*. Each end fitting 240*a*/240*b* has an internally threaded step bore 250*a*/250*b* therein for threadably engaging the external threads of proximal end portions 210*a*/210*b* of central bodies 192*a*/192*b*. The distal end portions of bladders 150*a*/150*b* are sealingly captured, such as by a press fit, between nose members 220*a*/220*b* and central bodies 192*a*/192*b*. Similarly, the proximal end portions of bladders 150*a*/150*b* are sealingly captured, such as by a press fit, between proximal end portions 210*a*/210*b* of central bodies 192*a*/192*b* and end fittings 240*a*/240*b*. Moreover, end fitting 240*b* has the bore 245 therein for receiving an end portion of conduit 160, the bore 245 being in communication with channel 193 formed in central bodies 192*a*/192*b*. In this manner, fluid can be conducted from conduit 160 and into channel 193 to pressurize bladders 150*a*/150*b* and conducted from channel 193 and into conduit 160 to depressurize bladders 150*a*/150*b*. It will be appreciated from the description hereinabove that use of this alternative embodiment of mandrel 140 allows for simultaneous formation of expanded regions 270/280 because bladders 150*a*/150*b* will substantially simultaneously expand as the expansion fluid flows through channel 193 to bladders 150*a*/150*b*. Thus, the double bladder mandrel 140 need not be repositioned in tube 90*a* to individually or sequentially form expanded regions 270/280 because expanded regions 270/280 are formed simultaneously. Consequently, this alternative embodiment of mandrel 140 allows for more support plates 100 to be stabilized in a shorter period of time.

It will be appreciated from the description hereinabove, that an advantage of the present invention is that crack 92 will not be uncovered, such as during a depressurization transient (e.g., main steam line break), by the surrounding support plate 100 because expanded regions 270/280 or expansion joints 340/350 restrict transverse displacement or deflection of support plate 100.

It will be further appreciated from the description hereinabove, that another advantage of the present invention is that sleeve 330 provides stiffness to tube 90*a*. This is important should tube 90*a* become severed due to primary coolant pressure acting on through-wall crack 92. Even if the tube 90*a* becomes severed at a location immediately above or below support plate 100, then the severed tube ends of tube 90*a* are now unconstrained by tube support plate 100 and may laterally move due to hydraulic forces to damage adjacent nonleaking heat transfer tubes 90*b* during the transient event. The increased stiffness of tube 90*a* occasioned by the presence of sleeve 330 precludes such severed tube ends from laterally moving to damage the undamaged tube 90*b*.

Moreover, under certain assumed crack morphologies it is possible that axial pressure loads on tube 90*a* during the transient event could conceivably cause axial tensile tearing of the crack 92 to produce the "tube burst" condition. Therefore, it will be appreciated from the description hereinabove, that a further advantage of the present invention is that tube expansion in combination with restriction of support plate movement reduces axial tube burst probability to a negligible level in the typical nuclear steam generator. Therefore, tube repair limits are not required to satisfy tube burst margins because the probability of tube burst is negligible. In other words, by use of the invention tube repair (e.g., tube plugging) will be required only as necessary to satisfy allowable leakage limits during accident conditions.

Although the invention is illustrated and described herein in its preferred embodiments, it is not intended that the invention as illustrated and described be limited to the details shown, because various modifications may be obtained with respect to the invention without departing from the spirit of the invention or the scope of equivalents thereof.

Therefore, what is provided is a method of restricting transverse displacement or deflection of a nuclear heat exchanger tube support plate during a transient event, which tube support plate may be of the type found in nuclear steam generators.

What is claimed is:

1. In a nuclear heat exchanger having a tubular member extending through a hole of predetermined diameter formed through a plate member disposed in the heat exchanger, the tubular member having an open end and the plate member having a first side and a second side thereof, a method of restricting transverse displacement of the plate member, comprising the steps of:

(a) radially expanding the tubular member adjacent the first side of the plate member, the tubular member being expanded to a diameter greater than the diameter of the hole formed through the plate member to define a first expanded region; and (b) radially expanding the tubular member adjacent the second side of the plate member, the tubular member being expanded to a diameter greater than the diameter of the hole formed through the plate member to define a second expanded region, whereby the plate member is captured between the first expanded region and the second expanded region as the tubular member is expanded and whereby the first expanded region and the second expanded region coact to restrict transverse displacement of the plate member as the plate member is captured between the first expanded region and the second expanded region.

2. The method of claim 1, further comprising the step of disposing a stay rod in the tubular member so as to span the first expanded region and the second expanded region for restricting lateral movement of the tubular member.

3. The method of claim 1, further comprising the step of sealingly disposing a plug into the open end of the tubular member to sealingly plug the tubular member to prevent a heat transfer fluid from entering the tubular member to corrode the tubular member.

4. In a nuclear heat exchanger having a heat transfer tube extending through a hole of predetermined diameter formed through a support plate disposed in the heat exchanger, the tube having an open end and the support plate having a first side disposed parallel to a second side thereof, a method of restricting transverse displacement of the support plate, comprising the steps of:

(a) disposing a sleeve in the tube, so that the sleeve spans the support plate;

(b) radially expanding the tube and the sleeve adjacent the first side of the support plate, the tube and the sleeve being expanded to a diameter greater than the diameter of the hole formed through the support plate to define a sleeve-to-tube first expansion joint thereat; and (b) radially expanding the tube and the sleeve adjacent the second side of the support plate, the tube and the sleeve being expanded to a diameter greater than the diameter of the hole formed through the support plate to define a sleeve-to-tube second expansion joint thereat, whereby the support plate is captured between the first expansion joint and the second expansion joint as the tube and the sleeve are expanded and whereby the first expansion joint and the second expansion joint coact to restrict transverse displacement of the support plate as the support plate is captured between the first expansion joint and the second expansion joint.

5. The method of claim 4, wherein said step of radially expanding the tube and the sleeve adjacent the first side of the support plate comprises the steps of:

(a) disposing an expansion mandrel in the sleeve; and (b) operating the expansion mandrel to radially expand the tube and the sleeve.

6. The method of claim 5, wherein said step of radially expanding the tube and the sleeve adjacent the second side of the support plate comprises the steps of:

(a) disposing the expansion mandrel in the sleeve; and (b) operating the expansion mandrel to radially expand the tube and the sleeve.

7. The method of claim 6, wherein said step of operating the expansion mandrel comprises the step of automatically controllably operating the expansion mandrel by operating a computer associated with the expansion mandrel.

8. The method of claim 4, further comprising the step of disposing a stay rod in the tube to span the first expansion joint and the second expansion joint for restricting lateral movement of the sleeve and the tube.

9. The method of claim 4, further comprising the step of sealingly disposing a tube plug into the open end of the tube to sealingly plug the tube to prevent a heat transfer fluid from entering the tube to corrode the tube.

10. In a nuclear heat exchanger having a plurality of heat transfer tubes extending through respective ones of a plurality of holes of a predetermined diameter formed through a support plate disposed in the heat exchanger, the support plate capable of laterally supporting the tubes, each of the tubes having an open end and the support plate having a first side disposed parallel to a second side thereof, a method of restricting transverse displacement of the support plate, comprising the steps of:

(a) disposing an expansion mandrel in a predetermined one of the tubes, the expansion mandrel having a sleeve connected thereto;

(b) locating the expansion mandrel and the sleeve in the predetermined tube, so that the sleeve spans the support plate;

(c) radially expanding the predetermined tube and the sleeve adjacent the first side of the support plate by operating the expansion mandrel, the tube and the sleeve being expanded to a diameter greater than the diameter of the hole formed through the support plate to define a sleeve-to-tube first expansion joint thereat;

(d) radially expanding the tube and the sleeve adjacent the second side of the support plate by operating the expansion mandrel, the tube and the sleeve being expanded to a diameter greater than the diameter of the hole formed through the support plate to define a sleeve-to-tube second expansion joint thereat; and (e) sealingly disposing a tube plug into the open end of the tube to sealingly plug the tube to prevent a heat transfer fluid from entering the tube to corrode the tube.

11. The method of claim 10, wherein said step of radially expanding the tube and the sleeve adjacent the first side of the support plate comprises the step of automatically radially expanding the tube and the sleeve by operating a computer associated with the expansion mandrel.

12. The method of claim 11, wherein said step of radially expanding the tube and the sleeve adjacent the second side of the support plate comprises the step of automatically radially expanding the tube and the sleeve by operating a computer associated with the expansion mandrel.

13. The method of claim 10, further comprising the step of disposing a stay rod in the sleeve so as to span the first expansion joint and the second expansion joint for restricting lateral movement of the sleeve and the tube.

* * * * *